US006948206B1

(12) United States Patent
Valencia

(10) Patent No.: US 6,948,206 B1
(45) Date of Patent: Sep. 27, 2005

(54) INFLATABLE HAMMOCK MATTRESS

(76) Inventor: Jose Valencia, 789 Ballard St., El Cajon, CA (US) 92019

( * ) Notice: Subject to any disclaimer, the term of this patent is extended or adjusted under 35 U.S.C. 154(b) by 0 days.

(21) Appl. No.: 10/735,802

(22) Filed: Dec. 15, 2003

(51) Int. Cl.[7] ..... A47B 85/00
(52) U.S. Cl. ..... 5/732; 5/713; 5/120; 5/122
(58) Field of Search ..... 5/120, 122, 123, 5/713, 731, 732

(56) References Cited

U.S. PATENT DOCUMENTS 1,576,211 A * 3/1926 O'Kane et al. ..... 5/710
2,284,900 A * 6/1942 Henderson et al. ..... 5/122
2,549,597 A * 4/1951 Harris et al. ..... 5/711
2,623,574 A 12/1952 Damsch
4,594,743 A * 6/1986 Owen et al. ..... 5/111
5,072,465 A 12/1991 Lyons, Jr.
5,115,525 A * 5/1992 Lovitt ..... 5/120
5,560,056 A * 10/1996 Tai ..... 5/120
D380,623 S 7/1997 McCain
5,669,182 A 9/1997 Griffis
6,543,073 B2 * 4/2003 Wu ..... 5/713

* cited by examiner

*Primary Examiner*—Michael Trettel

(57) ABSTRACT

An inflatable hammock mattress includes a body defining an inflatable cavity and being removably positionable onto a hammock. The body has an arcuate bottom portion and a non-planar top portion integral therewith. A plurality of side rails are connected to the top portion and extend around the perimeter of the body for assisting a user to maintain stability during operating conditions. The mattress further includes a plurality of valves disposed at one end of the body and a power-operated device including a plurality of toggling switches for automatically inflating and deflating the mattress.

15 Claims, 3 Drawing Sheets

INFLATABLE HAMMOCK MATTRESS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to inflatable air mattresses and, more particularly, to an inflatable air mattress designed for use in a hammock.

2. Prior Art

The hammock is well known in the industry as a unique sleeping and relaxation apparatus. It is inexpensive, portable and durable. Its gentle swinging motion provides a level of repose that few other sleeping apparatuses can match. Unfortunately, its unique qualities also have drawbacks.

While the use of a hammock provides a smooth, swaying sensation, it is not considered to be very comfortable. Most hammocks are made of rope or nylon, neither of which is very comfortable when laid upon. In addition, the very design of the hammock lends itself to problems. When users roll around the hammock they have a tendency to fall off or become entangled in the many holes in the web. Hammocks are not very stable because they are designed to swing to provide their unique relaxation. Inexperienced users, in particular, have difficulty dealing with the webbing of the hammock.

Prior art has combined common sleeping bags with hammocks in an attempt to rectify some of these problems. While they solve some of the problems, some problems are left unanswered. These problems involve comfort, installation, lack of side support, and sag in both length-wise and width-wise directions. A firmer sleeping apparatus that fits securely into the hammock and is easily removed would provide a solution to these problems.

Accordingly, a need remains for an inflatable air mattress shaped to fit securely into a hammock with side supports for greater safety and comfort.

BRIEF SUMMARY OF THE INVENTION

In view of the foregoing background, it is therefore an object of the present invention to provide an air mattress for improving the comfort and safety of a hammock. These and other objects, features, and advantages of the invention are provided by an inflatable hammock mattress including a body defining an inflatable cavity and being removably positionable onto a hammock.

The body has a substantially oval shape and includes an arcuate bottom portion and a non-planar top portion integral therewith. A plurality of side rails preferably formed from plastic are connected to the top portion and extend partially around a perimeter of the body between opposed end portions thereof. Such side rails extend upwardly from the top portion for allowing a user to maintain the mattress in a substantially stable position during operating conditions. The body has a centrally disposed longitudinal axis and the plurality of side rails are oppositely and substantially symmetrically spaced apart from the longitudinal axis.

The mattress further includes a plurality of valves disposed at one of the opposed end portions of the body and a power-operated device cooperating with the plurality of valves for supplying and removing air from the body. The power-operated device includes a plurality of switches for toggling same between inflating and deflating modes.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
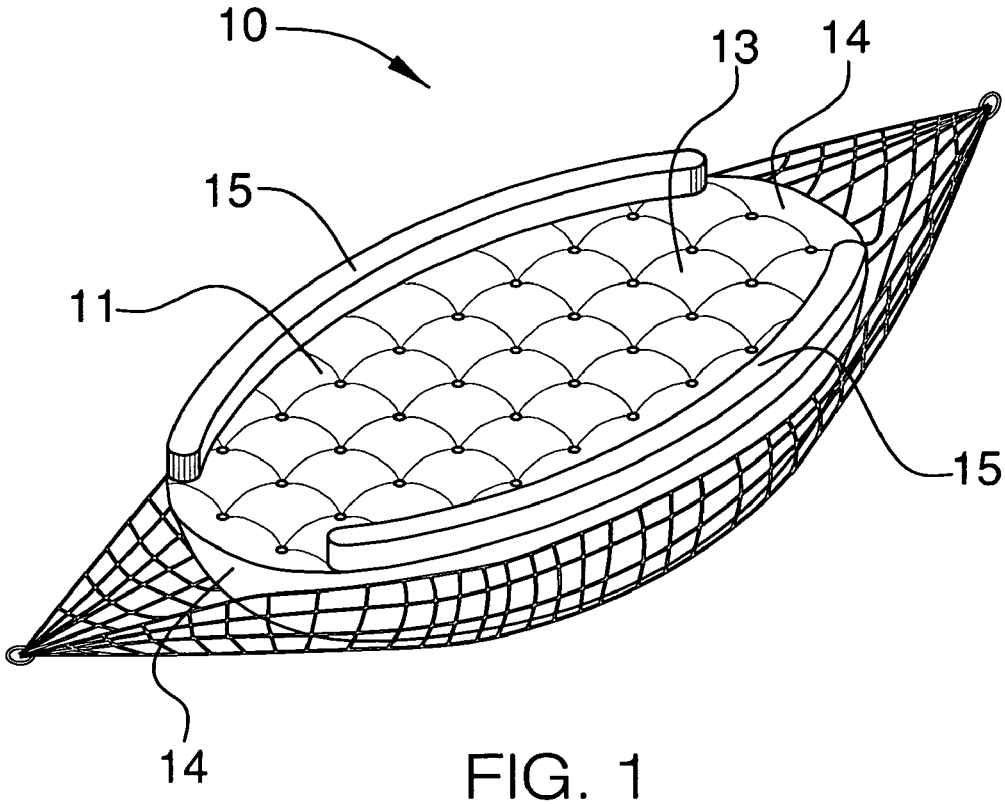
FIG. 1 is a perspective view showing an inflatable hammock mattress in a preferred environment, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The apparatus of this invention is referred to generally in FIGS. 1–5 by the reference numeral 10 and is intended to provide an inflatable mattress for a hammock. It should be understood that the mattress 10 may be used in various environments and, therefore, should not be limited for use only with a hammock.

Figure 2:
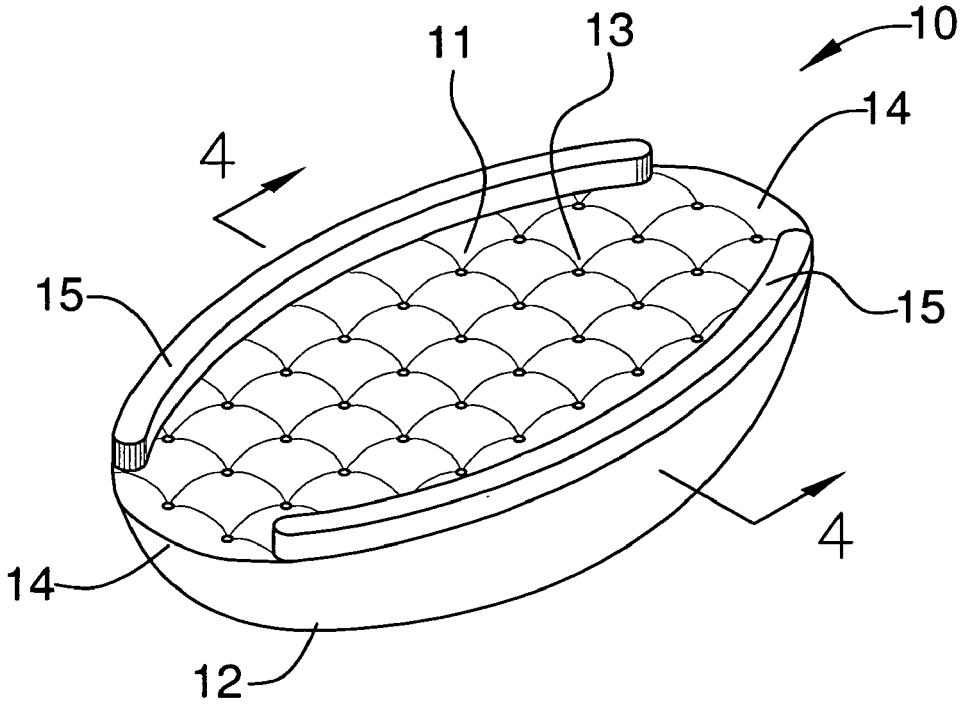
FIG. 2 is a perspective view of the apparatus shown in FIG. 1.

Referring initially to FIGS. 1 and 2, the mattress 10 includes a body 11 defining an inflatable cavity and being removably positionable onto a hammock. The body 11 has a substantially oval shape and includes an arcuate bottom portion 12 and a non-planar top portion 13 integral therewith. The body 11 further includes opposed end portions 14 and a plurality of side rails 15 formed from plastic and connected to the top portion 13. Such side rails 15 extend partially around a perimeter of the body 11. The body 11 is preferably formed from velvet-coated, vinyl material 16 and has a corrugated top surface for providing comfort to a user, as perhaps best shown in FIG. 4. Of course, the top surface of the body may have an alternate pattern commonly used on existing mattresses, as well known in the industry.

Still referring to FIGS. 1 and 2, the plurality of side rails 15 extend upwardly from the top portion 13 for allowing a user to maintain the mattress 10 in a substantially stable position during operating conditions. This enables a user to firmly grasp the side rails 15 and steady the hammock when entering and exiting from opposed sides. Advantageously, the plurality of side rails 15 also serve as arm rests for a user and further prevent a user from falling out of the hammock during operating conditions. The body 11 has a centrally disposed longitudinal axis (not shown) and the plurality of side rails 15 are oppositely and substantially symmetrically spaced apart from the longitudinal axis. Of course, the shape of such side rails 15 may be adjusted for accommodating a particular user.

Figure 3:
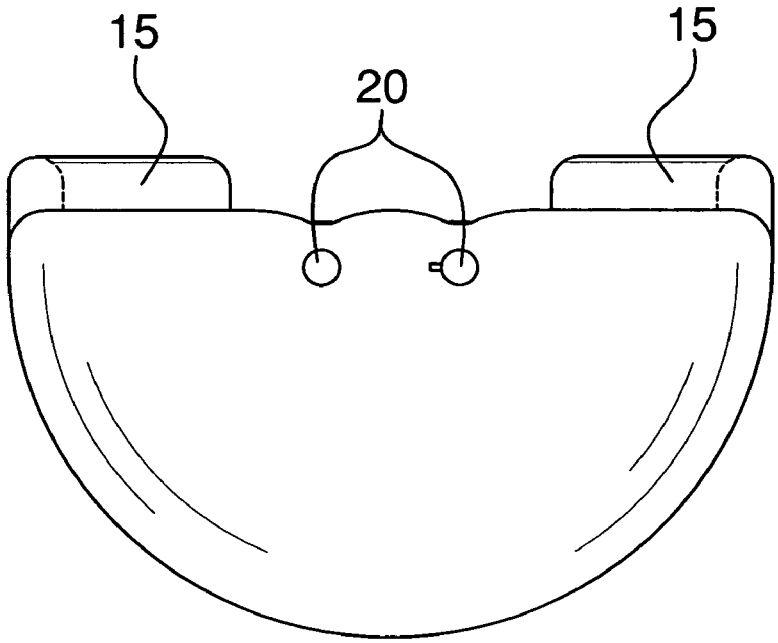
FIG. 3 is a front-end view of the apparatus shown in FIG. 2.
Figure 4:
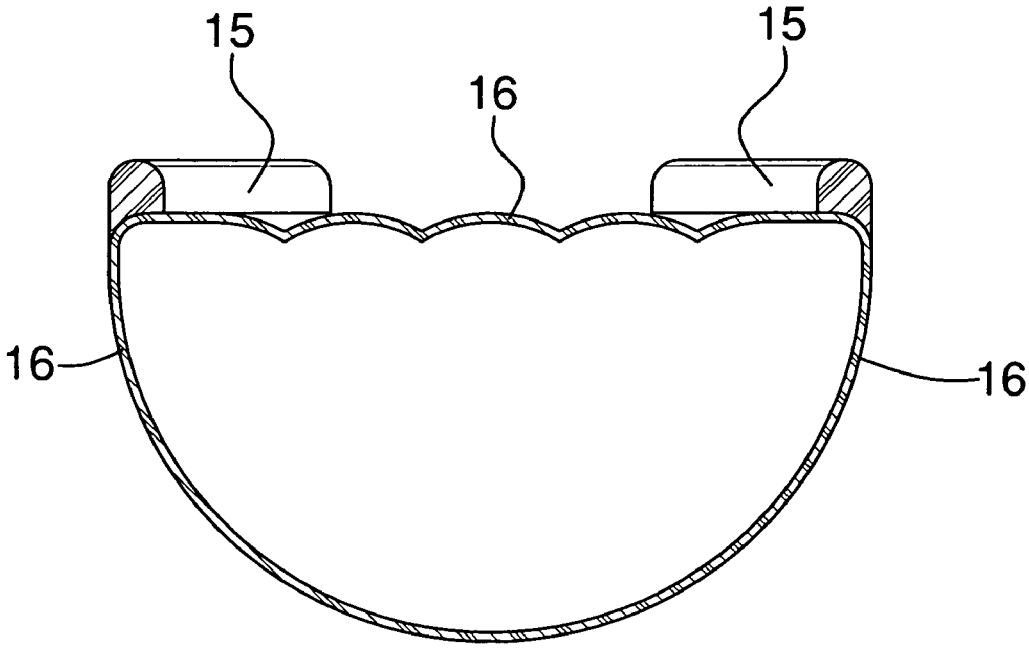
FIG. 4 is a cross-sectional view taken along line 4—4 in FIG. 1.
Figure 5:
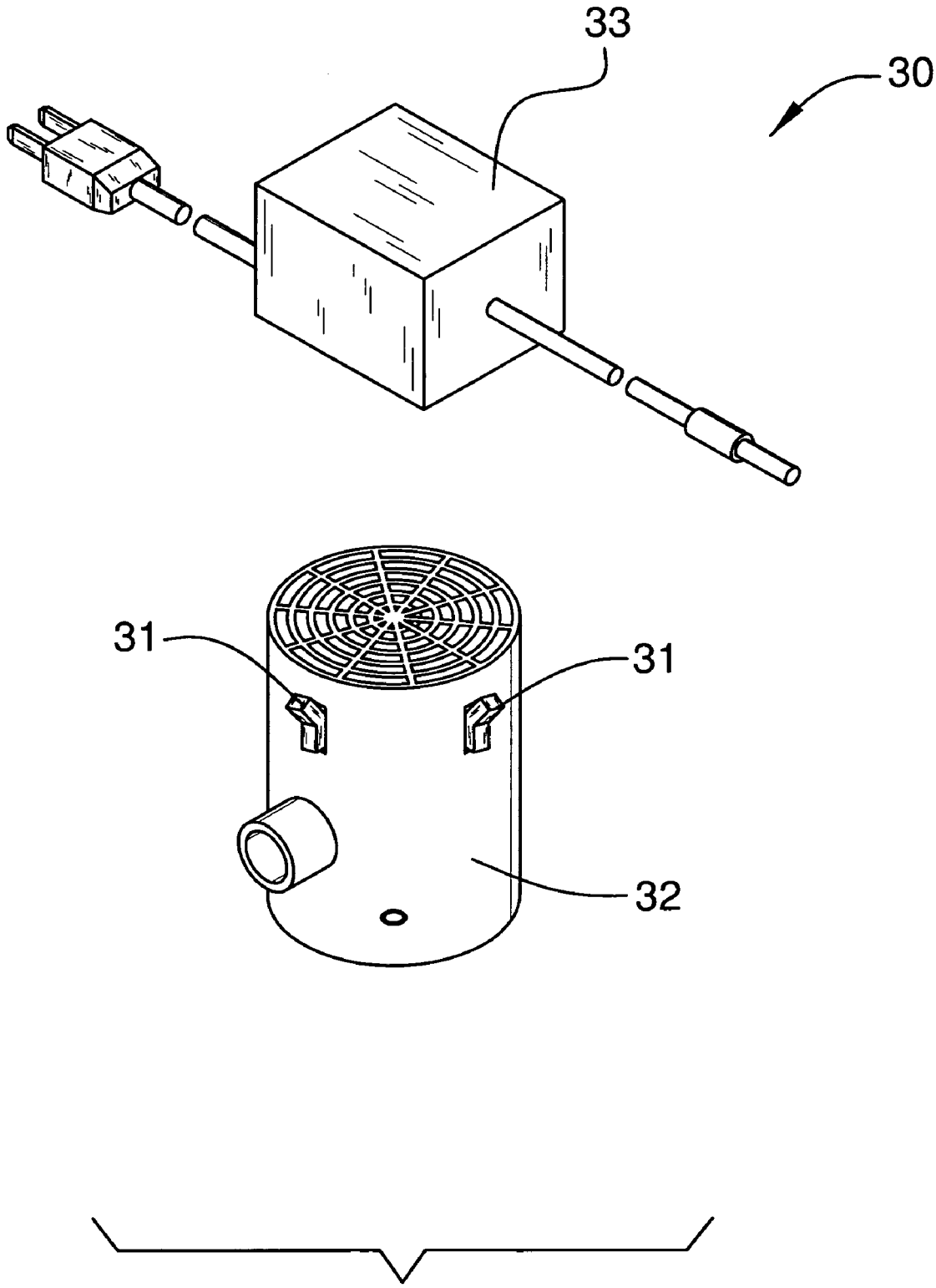
FIG. 5 is a perspective view of the power-operated device for supplying and removing air from the mattress.

Now referring to FIG. 3, the mattress 10 further includes a plurality of valves 20 disposed at one of the opposed end portions 14 of the body. The mattress further includes a power-operated device 30 for cooperating with the plurality of valves 20 and for supplying and removing air from the body 11. Now referring to FIG. 5, the device 30 further includes a plurality of switches 31 for toggling same between inflating and deflating modes. This allows a user to quickly inflate and deflate the mattress 10 with minimum effort and time. Once deflated, the mattress 10 can be folded and stored in a small space or taken on camping trips or vacations. The device 30 preferably includes a rechargeable DC blower 32 and a charging transformer 33, as well known in the industry, so that the mattress 10 can be inflated or deflated in places where no AC electrical power source is available.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the: United States is:

1. An inflatable hammock mattress comprising:

a body defining an inflatable cavity and being removably positionable onto a hammock, said body including an arcuate bottom portion and a top portion integral therewith and further including opposed end portions;

a plurality of side rails connected to said top portion and extending partially around a perimeter of said body, said plurality of side rails extending upwardly from said top portion and for allowing a user to maintain said mattress in a substantially stable position during operating conditions;

a plurality of valves disposed at one said opposed end portions of said body; and a power-operated device cooperating with said plurality of valves and for supplying and removing air from said body.

2. The mattress of claim 1, wherein said body has a substantially oval shape.

3. The mattress of claim 1, wherein said top surface is formed to be non-planar.

4. The mattress of claim 1, wherein said device comprises a plurality of switches for toggling same between inflating and deflating modes.

5. The mattress of claim 1, wherein said plurality of side rails are formed from plastic.

6. The mattress of claim 1, wherein said body has a centrally disposed longitudinal axis and said plurality of side rails are oppositely and substantially symmetrically spaced apart from the longitudinal axis.

7. An inflatable hammock mattress comprising:

a body defining an inflatable cavity and being removably positionable onto a hammock, said body including an arcuate bottom portion and a top portion integral therewith and further including opposed end portions;

a plurality of side rails connected to said top portion and extending partially around a perimeter of said body, said plurality of side rails extending upwardly from said top portion and for allowing a user to maintain said mattress in a substantially stable position during operating conditions, said body has a centrally disposed longitudinal axis and said plurality of side rails are oppositely and substantially symmetrically spaced apart from the longitudinal axis;

a plurality of valves disposed at one said opposed end portions of said body; and a power-operated device cooperating with said plurality of valves and for supplying and removing air from said body.

8. The mattress of claim 7, wherein said body has a substantially oval shape.

9. The mattress of claim 7, wherein said top surface is formed to be non-planar.

10. The mattress of claim 7, wherein said device comprises a plurality of switches for toggling same between inflating and deflating modes.

11. The mattress of claim 7, wherein said plurality of side rails are formed from plastic.

12. An inflatable hammock mattress comprising:

a body defining an inflatable cavity and being removably positionable onto a hammock, said body including an arcuate bottom portion and a non-planar top portion integral therewith and further including opposed end portions;

a plurality of side rails connected to said top portion and extending partially around a perimeter of said body, said plurality of side rails extending upwardly from said top portion and for allowing a user to maintain said mattress in a substantially stable position during operating conditions, said body has a centrally disposed longitudinal axis and said plurality of side rails are oppositely and substantially symmetrically spaced apart from the longitudinal axis;

a plurality of valves disposed at one said opposed end portions of said body; and a power-operated device cooperating with said plurality of valves and for supplying and removing air from said body.

13. The mattress of claim 12, wherein said body has a substantially oval shape.

14. The mattress of claim 12, wherein said device comprises a plurality of switches for toggling same between inflating and deflating modes.

15. The mattress of claim 12, wherein said plurality of side rails are formed from plastic.

* * * * *